US005222013A

United States Patent [19]

Schwalm

[11] Patent Number: 5,222,013

[45] Date of Patent: Jun. 22, 1993

[54] ELECTROSTATIC DISCHARGE DEVICE

[76] Inventor: Walter A. Schwalm, 745 Barberry La., Lake Forest, Ill. 60045

[21] Appl. No.: 665,357

[22] Filed: Mar. 6, 1991

[51] Int. Cl.[5] ..... H05F 3/00

[52] U.S. Cl. ..... 361/212; 361/216; 361/220

[58] Field of Search ..... 361/212, 216, 220, 222

[56] References Cited

U.S. PATENT DOCUMENTS

| | | | |
|---|---|---|---|
| 3,099,774 | 7/1963 | Crane | 317/2 |
| 3,745,412 | 7/1973 | Ruff | 317/2 R |
| 3,780,345 | 12/1973 | Earman, Jr. | 361/220 |
| 4,104,695 | 8/1978 | Hollis et al. | 361/220 |
| 4,586,106 | 4/1986 | Frazier | 361/212 |
| 4,605,984 | 8/1986 | Fiedler | 361/220 |
| 4,720,764 | 1/1988 | Lucas | 361/212 |

*Primary Examiner*—A. D. Pellinen
*Assistant Examiner*—Michael A. Friedhofer
*Attorney, Agent, or Firm*—Jon Carl Gealow; James M. Wetzel

[57] ABSTRACT

An electrostatic discharge device which is secured over the cover of a wall mounted switch to provide a readily available instrument for discharging an electrostatic charge developed on the body of a person. The electrostatic discharge device includes in a series electrical circuit a grounded conductor, a current limiting resistor, an electrical discharge component, and an electrode for receiving a current flow to discharge an electrostatic charge.

3 Claims, 1 Drawing Sheet

ELECTROSTATIC DISCHARGE DEVICE

BACKGROUND OF THE INVENTION

1. Field of the Invention

This invention relates to an improved electrostatic discharge assembly for use with electric wall switches.

2. Background Information

It is well known that, given the proper conditions, a persons body may accumulate a substantial electrostatic charge. The rapid discharge of such a substantial electrostatic charge often results in a painful or at least unpleasant shock. Conditions which favor the development of such substantial electrostatic charges are, the air being drier than normal, such as most frequently occurs in buildings in colder climates during the winter months, walking on rugs, particularly wool rugs, and sliding or otherwise moving across fabric, such as on upholstered furniture.

An electrostatic charge having been developed on a persons body, the touching or close approaching to a good electrical conductor, particularly a grounded conductor, will result in the rapid discharge, through an arc with a large current flow, of the accumulated electrostatic charge. This rapid discharge is frequently accompanied by a painful or at least unpleasant shock. The degree of painfulness or unpleasantness of the shock can be reduced by reducing the magnitude of the current flowing from the persons body through the discharge path.

Numerous devices have been proposed in the past which are intended to bring about the desired reduction in current flow. One such device is shown in U.S. Pat. No. 3,745,412—Ruff, issued Jul. 10, 1973. The Ruff patent reveals an electric discharge device worn as a ring by the person from whose body an electrostatic charge is to be removed. A metal band in intimate contact with the wearer's finger, is electrically connected to an electrode located on the face of the ring by a resistor and a glow lamp connected in series. To dissipate an electrostatic charge, the electrode of the ring must be brought into close proximate to, or touch, a grounded conductor before any portion of the wearers body does so. A person may well consider the wearing of such a ring to be an inconvenience, such that it would not be worn at all times. As a result, it may not be worn when it is needed. Since such a ring would normally only be needed when within a building, a person would not be inclined to wear it when outside. Forgetting to replace the ring on their finger when re-entering a building presents the possibility of a substantial shock from an electrostatic discharge.

Static discharge devices intended for other specific applications have been disclosed in United States patents. For instance, U.S. Pat. No. 4,720,764—Lucas, issued Jan. 19, 1988 and U.S. Pat. No. 4,605,984—Fiedler, issued Aug. 12, 1986 revealed discharge devices intended for use by persons working with electronic components. Both of these devices require the wearing of a strap around the user's wrist.

SUMMARY OF THE INVENTION

Accordingly, it is an object of this invention to provide an electrostatic discharge assembly which is easily mounted in a position where it will be readily available for use by a person having a need to discharge an electrostatic charge. It is a further object of this invention to provide an electrostatic discharge assembly which is readily available for use, but which need not be worn by or attached to the user, such as in the form of a ring or wrist strap It is a further object of this invention to provide an electrostatic discharge assembly which when installed as intended for use, will be connected to a known ground for discharge of an electrostatic charge. It is a still further object of this invention to provide an electrostatic discharge assembly which is constructed such that a discharge of an electrostatic charge from a person's body is initiated through a corona discharge as a person's finger approaches the assembly.

In accordance with this invention, an electrostatic discharge assembly is provided in an electrically insulating housing having a base and a cover. The assembly includes as a fastening means, a conductive screw which is engaged in one of the threaded holes provided in a switch mounting plate for a screw normally used to secure a switch cover plate. The conductive screw, which is secured in the base of the housing, is connected in an electrical series circuit with a resistor, an electrical discharge component, such as a neon discharge tube and an electrode, all of which are mounted within the insulating housing. The electrode has two portions, with one of the portions extending through the housing and terminates in a sharp point. The portion of the electrode extending outside of the housing, including the sharp point, is confined within a recess formed in the housing. A person wishing to discharge an electrostatic charge brings a finger toward the open end of the recess. A corona discharge is initiated between the finger and the sharp point as the finger approaches the recess in the housing. The finger, which does not touch the sharp point, is in close enough proximity to the sharp point to be discharged through it. The discharge may be initiated while the finger is one half inch from the sharp point. The insulating housing when formed of a translucent material, permits the user to observe the discharge of an electrostatic charge through the neon discharge tube.

DETAILED DESCRIPTION OF THE PREFERRED EMBODIMENT

Figure 1:
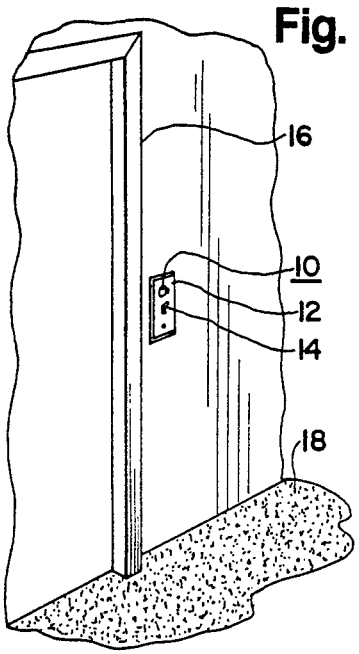
FIG. 1 is a perspective view of a typical installation of an electrostatic discharge device constructed in accordance with this invention.
Figure 2:
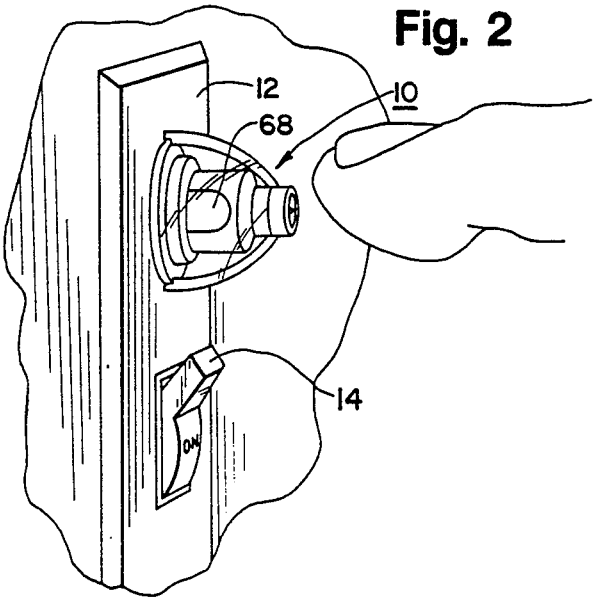
FIG. 2 is an enlarged view of the electrostatic discharge device of this invention as shown in FIG. 1, being contacted by a person's finger.

Referring to FIG. 1, the electrostatic discharge device 10 of this invention is shown installed over a wall plate 12 of an electric wall switch 14 which, as is customary, is mounted adjacent to a door frame 16. As is typical in those situations where an electrostatic charge on a person is most likely to occur, the floor is shown covered by a carpet 18.

Figure 3:
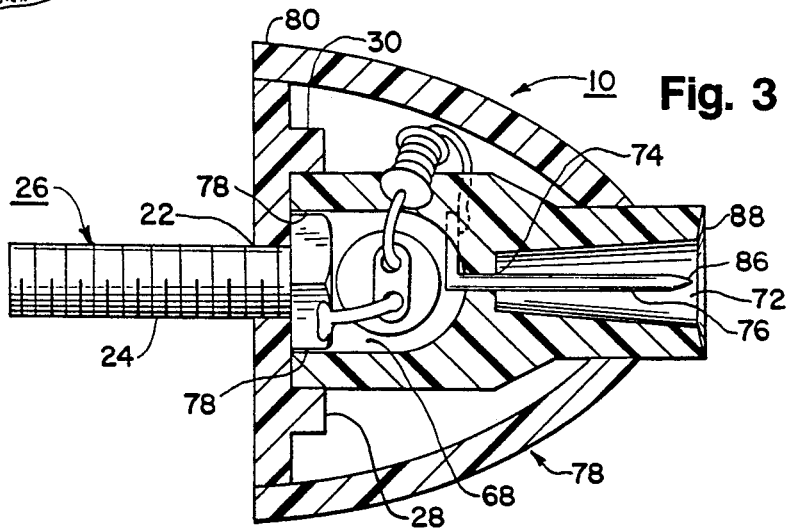
FIG. 3 is an enlarged cross sectional view of the electrostatic discharge device shown in FIG. 1.
Figure 4:
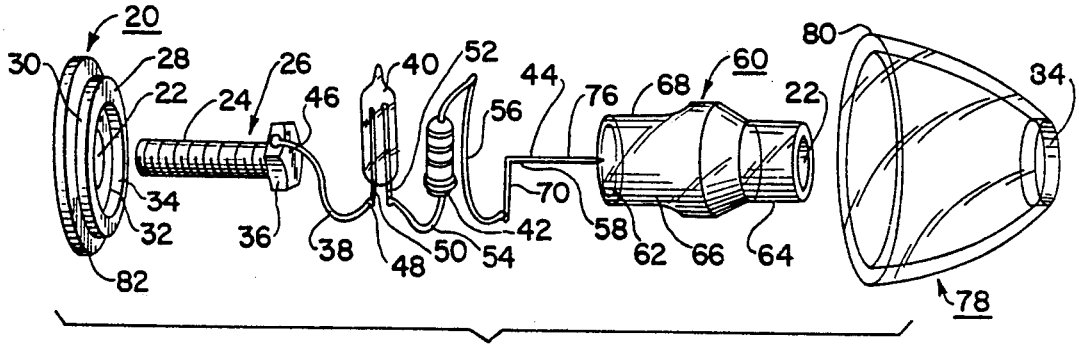
FIG. 4 is an exploded perspective view of the electrostatic discharge device shown in FIG. 3.

Referring particularly to FIG. 4, the components and the assembly of the components of the electrostatic discharge device of this invention will be described. A cylindrical base 20 is formed of an electrically insulating material. The base 20 is provided at its center with a hole 22 which is or proper size to receive shank 24 of a screw 26. The bottom surface of base 22 as shown in FIG. 3 is flat, while the top surface is provided with an annular projection 28 having a cylindrical outer wall 30 and forming a recess 32 having a cylindrical sidewall 34. The shank 24 of screw 26 is passed through the hole 22 in the base such that head 36 of screw 26 is received within the recess 32.

Additional electrical components of the electrostatic discharge device 10 include an electrical conductor 38, a neon glow tube 40, a resistor 42, and an electrode 44. One end 46 of the conductor 38 is secured to the head 36 of the screw 26, such as by welding, brazing or any other securing means which will provide a good electrical connection. Another end 48 of the conductor 38 is connected to a first terminal 50 of glow tube 40. Second terminal 52 of glow tube 40 is connected to a first lead 54 of resistor 42. Second lead 56 of resistor 42 is connected to a first end 58 of electrode 44. The electrical and mechanical connections between the electrical components may be made by suitable means, such as by soldering, welding, brazing or any other securing means which will provide a good electrical connection.

In assembling the electrostatic discharge device, all of the electrical components may be pre-connected so as to form a subassembly.

A further component of the electrostatic discharge device is an insulating electrode support member 60. The support member 60 is formed with a larger diameter lower end 62 and a smaller diameter upper end 64. The outer surface 66 of the lower portion 62 is sized to closely fit within the cylindrical sidewall 34 of the recess 32. A diametrical opening 68 is provided in the larger diameter portion 62 of the insulating electrode support member 60 to receive the neon glow tube 40 and a first segment 70 of electrode 44. The upper smaller diameter portion 64 of the electrode support member 60 is provided with a cylindrical recess 72. Extending from the bottom of the cylindrical recess 72 is an aperture 74 which is sized to receive a second segment 76 of the electrode 44. Segments 70 and 76 of electrode 44 are formed at right angles to each other. The second segment 76 of the electrode 44 is passed through the aperture 74, until first segment 70 engages the lower end of the aperture.

A cone shaped cover 78 is provided to enclose the electronic components, and the lower end 62 of electrode support member 60. The inside diameter of a base portion 80 of the cover 78 is designed to receive the outside diameter 82 of the base 20. The upper portion of the cone shaped cover 78 is provided with an aperture 84 sized to closely receive the smaller diameter portion 64 of the electrode support member 60.

To review the assembly of the electrostatic discharge device 10, the electrical components including screw 26, conductor 38, glow tube 40, resistor 42, and electrode 44 are first electrically and mechanically secured to each other by soldering, welding, brazing, or other suitable means. The shank 24 of screw 26 is placed through the hole 22 in the base 20 with screw head 36 being located in the recess 32. The second segment 76 of the electrode 44 is then passed through the aperture 74 in electrode support member 60. The leads 54 and 56 of the resistor, and the electrical conductor 38 are bent such that the neon glow tube 40 is positioned within the diametrical opening 68 in the electrode support member 60, and the resistor 42 is positioned along the outer surface 66 of the support member 60.

The electronic components are so positioned with respect to each other, that as the second segment 76 of the electrode is placed in its final position in the insulating electrode support member 60, the larger diameter portion 62 of the electrode support member is received within the recess 32 in the projection 28 of the base. Flat surfaces 78 are provided on the inside of the lower end 62 of the electrode support member 60 to engage opposite flat sides of the head 36 of the screw 26, so as to prevent the screw from turning with respect to the electrode support member 60 and the electronic components mounted thereon. The electrode support member 60 and screw head 36 may be secured to the base by any suitable means, such as by ultrasonic welding or by the use of a suitable adhesive.

As a final step in the assembly of the electrostatic discharge device, the cone shaped cover 78 is placed over the electrode support member 60 and the electrical components, such that the smaller diameter portion 64 of the electrode support member projects through the aperture 84 in the cone shaped cover, and the lower end of the cover is received over the base 20. As in the case of the insulating electrode support member, the cover 78 may be secured to the base by a suitable bonding means.

The positioning of the electronic components and particularly of the electrode 44, with respect to the base 20, the electrode support member 60, and the cover 78, is best shown in FIG. 3. It will be noted that a point 86 provided at the tip of second segment 76 of electrode 74 is located below the end 88 of the smaller diameter portion 64 of the electrode support member. Thus, when a finger is placed on the end 88 of the electrode support member, it is positioned close to, but does not contact the point 86.

In the preferred embodiment of this invention, the cone shaped cover 78 and the electrode support member 60 are formed of a translucent material such that the glow in the neon glow tube upon the discharge of an electrostatic charge will be observable.

The installation of the electrostatic discharge device of this invention in place of one of the screws holding the cover plate on a wall switch is particularly advantageous. According to the National Electrical Code, and the codes of most local governments, the switch support member into which the screw of the electrostatic discharge device of this invention is to be threaded is required by code provisions to be grounded. Further, a 6-32 threaded aperture in the switch support member is standard. By providing 6-32 threads on screw 26, the device 10 can be utilized with most if not all wall switches.

The electrostatic potential of a static charge which may develop on a person is frequently in the range of 15–25,000 volts. By limiting the magnitude, and extending the duration of the current flow from the discharge of the electrostatic charge, the hurtful or uncomfortable sensation received by the charged person is lessened or eliminated. It has been found that the resistor 42 should have a resistance in the range of 1 to 2 megohms. A resistance below 1 megohm may result in a person feeling the discharge, while a resistance higher than 2 megohms may limit the current flow and delay the initiation of the corona discharge more than is desirable. The discharge through the electrostatic discharge device, which in the case of a neon glow tube requires about 60 volts to fire, may last in the neighborhood of one second.

It should be apparent to those skilled in the art, that while what has been described is considered at present to be a preferred embodiment of the electrostatic discharge device of this invention. In accordance with the patent statues, changes may be made in the electrostatic discharge device without actually departing from the true spirit and scope of this invention.

The appended claims are intended to cover all such changes and modifications which fall in the true spirit and scope of this invention.

What is claimed is:

1. An electrostatic discharge assembly comprising:

a base formed of an electrical insulating material, a fastening means formed of an electrically conductive material, said fastening means having a first portion and a second portion, said first portion being adapted to be secured to a grounded electrical conductor, said second portion being secured to said base, a resistor supported from said base, an electrical discharge component supported from said base, said electrical discharge component having at least two electrical terminals, said electrical discharge component conducting when a sufficiently high electrical potential is applied to said terminals, an electrode supported from said base, said electrode having a first portion and a second portion, said fastening means, said resistor, said electrical discharge component, and said electrode being connected in a series circuit, a cover formed of an electrical insulating material, said cover forming with said base an enclosure, said resistor, said electrical discharge component, and said first portion of said electrode being located within said enclosure, said cover being provided with an aperture, said second portion of said electrode extending from said enclosure through said aperture in said cover and terminating in a point, whereby a static charge brought into the presence of said point of said second portion of said electrode will cause said electrical discharge component to conduct, such that said static charge will be discharged through said series circuit to the grounded electrical conductor.

2. An electrostatic discharge assembly comprising:

a base formed of an electrical insulating material, a fastening means formed of an electrically conductive material, said fastening means having a first portion and a second portion, said first portion being adapted to be secured to a grounded electrical conductor, said second portion being secured to said base, a resistor supported from said base, an electrical discharge component supported from said base, said electrical discharge component having at least two electrical terminals, said electrical discharge component conducting when a sufficiently high electrical potential is applied to said terminals, an electrode support member formed of an electrical insulating material supported on said base, said electrode support member having an extended portion with a recess formed therein, an electrode supported from said base by said electrode support member, said electrode having a first portion and a second portion, said fastening means, said resistor, said electrical discharge component, and said electrode being connected in a series circuit, a cover of an electrical insulating material, said cover forming with said base an enclosure, said resistor, said electrical discharge component, and said first portion of said electrode being located within said enclosure, said cover being provided with an aperture, said extended portion of said electrode support member extending through said aperture in said cover, said second portion of said electrode passing through said extended portion and extending into said recess and from said enclosure through said aperture in said cover, said second portion of said electrode terminating in a point, whereby a static charge brought into the presence of said point of said second portion of said electrode will cause said electrical discharge component to conduct, such that said static charge will be discharged through said series circuit to the grounded electrical conductor.

3. The electrostatic discharge assembly of claim 2, wherein said recess has an open end, and said point of said electrode is located within said recess adjacent said open end, whereby a persons finger placed on the open end of said recess will be adjacent to, but will not contact said point of said electrode.

* * * * *